US007811140B2

(12) United States Patent
Tabata et al.

(10) Patent No.: US 7,811,140 B2
(45) Date of Patent: Oct. 12, 2010

(54) TERMINAL FITTING WITH A WIRE RESTRICTION

(75) Inventors: Masaaki Tabata, Yokkaichi (JP); Kazuaki Takeda, Yokkaichi (JP); Hideo Adachi, Yokkaichi (JP)

(73) Assignee: Sumitomo Wiring Systems, Ltd. (JP)

( * ) Notice: Subject to any disclaimer, the term of this patent is extended or adjusted under 35 U.S.C. 154(b) by 0 days.

(21) Appl. No.: 12/488,763

(22) Filed: Jun. 22, 2009

(65) Prior Publication Data

US 2010/0035486 A1 Feb. 11, 2010

(30) Foreign Application Priority Data

| | | |
|---|---|---|
| Aug. 7, 2008 | (JP) | 2008-204869 |
| Aug. 29, 2008 | (JP) | 2008-221918 |
| Sep. 1, 2008 | (JP) | 2008-223985 |

(51) Int. Cl.
*H01R 4/10* (2006.01)

(52) U.S. Cl. ..... 439/877

(58) Field of Classification Search ..... 439/877, 439/595, 879–882

See application file for complete search history.

(56) References Cited

U.S. PATENT DOCUMENTS

| | | | | |
|---|---|---|---|---|
| 3,397,383 | A | | 4/1966 | Prifogle et al. |
| 5,380,218 | A | * | 1/1995 | Yamamoto et al. ..... 439/397 |
| 5,516,311 | A | | 5/1996 | Maejima |
| 5,899,775 | A | | 5/1999 | Davis et al. |
| 7,402,089 | B1 | | 7/2008 | Myer et al. |

FOREIGN PATENT DOCUMENTS

| | | |
|---|---|---|
| JP | 2004-303526 | 10/2004 |
| JP | 2005-222815 | 8/2005 |

* cited by examiner

*Primary Examiner*—Chandrika Prasad
(74) *Attorney, Agent, or Firm*—Gerald E. Hespos; Michael J. Porco

(57) ABSTRACT

A terminal fitting (10, 120, 210, 230) has a connecting portion (11, 121, 211) to be connected with a mating terminal and a wire barrel (12, 126, 212) to be crimped into connection with an end portion of a wire (20, 110, 220). A restriction (18, 152, 218A, 231) is between the connecting portion (11, 121, 211) than the wire barrel (12, 126, 212) and faces a placing surface of a bottom plate (16, 123, 216) where the end portion of the wire (20, 110, 220) is to be placed for restricting an upward movement of the end portion of the wire (20, 110, 220).

13 Claims, 14 Drawing Sheets

TERMINAL FITTING WITH A WIRE RESTRICTION

BACKGROUND OF THE INVENTION

1. Field of the Invention

The invention relates to a terminal fitting including a wire barrel to be crimped into connection with an end portion of a wire.

2. Description of the Related Art

Japanese Unexamined Patent Publication No. 2004-303526 discloses a terminal fitting with a connecting portion to be connected with a mating terminal. A wire barrel is disposed behind the connecting portion and is configured to be crimped into connection with an exposed core of an end portion of a wire. The wire barrel is crimped at a position where the leading end of the core projects forward, so that the entire wire barrel is crimped into connection with the core. Further reference is made to Japanese Unexamined Patent Publication No. 2005-222815.

The leading end of a core that projects forward from the wire barrel tends to be widened and may bend up when a wire barrel is crimped into connection with an end portion of a wire. A retainer may be mounted behind a connecting portion of the terminal fitting to retain the terminal fitting. However, a core that is bent up behind the connecting portion of the terminal fitting hinders the insertion of the retainer to a proper position.

Automatic wiring harnesses and the like frequently use cores made of aluminum alloys instead of cores made of copper alloys to save weight and for other reasons. Oxide films of aluminum alloys are more difficult to remove than those of copper alloys. Therefore, measures need to be taken to prevent an increase of contact resistance. For example, a method may be employed for more strongly crimping a wire barrel. However, a core that is tightened more strongly is bent up more notably. Therefore a device for preventing the end portion of the wire from being bent up has been hoped for.

There have been also cases where a core loosens and a front end portion of the loosened core is deformed to become wider.

The invention is developed in view of the above situation and an object thereof is to provide a terminal fitting and a connecting method allowing a proper connection to the wire.

SUMMARY OF THE INVENTION

The invention relates to a terminal fitting with a connecting portion to be connected with a mating terminal, a wire barrel to be crimped into connection with an end portion of a wire, and at least one restriction. The restriction is closer to the connecting portion than to the wire barrel and substantially faces a placing surface of a base plate where the end portion of the wire is to be placed. The restriction is capable of restricting upward movement of the end portion of the wire in a direction away from the base plate and/or for restricting a widening of the end portion of the wire. Accordingly, the connection between wire and terminal fitting can be improved.

The disposition of the restriction between the wire barrel and the connecting portion avoids complicating the shapes of both the wire barrel and the connecting portion.

The restriction may be formed at the base plate to ensure a formation region for the restriction without any problem.

The base plate may be formed with two side walls by bending opposite lateral edge portions of the base plate. Additionally, the restriction may be formed by being bent at the side wall to extend substantially toward a side where the end portion of the wire is to be placed. In contrast, a restriction formed by cutting and bending the base plate creates an opening in the base plate and reduces the strength of the terminal fitting. No such opening is formed by the subject invention, and hence the terminal fitting is not weakened.

The restriction may be a bulge in the base plate to reduce material cost as compared with a restriction that extends from the base plate.

At least one front stop may be formed at a position closer to the connecting portion than to the wire barrel for contacting a longitudinal front end of the wire and for arranging the wire at a proper position. The front stop enables the wire to be positioned easily in a longitudinal direction.

The front stop may be formed integral or unitary to the restricting portion to avoid complicating the construction of the terminal fitting.

The restriction may bulge out from the base plate. More particularly, the front stop and the restriction may be a dome-shaped bulge formed by extruding, bulging or embossing the base plate. The bulge enables the front stop and the restriction to be formed easily.

At least one reinforcement may be formed closer to the connecting portion than to the wire barrel for increasing the rigidity of the base plate. Accordingly, the base plate is not deformed at the end closer to the connecting portion than to the wire barrel.

The reinforcement may be formed by hammering the base plate to project in the form of a rib and may extend in forward and backward directions at least partly in the connecting portion for more reliably prevent the deformation of the base plate.

The base plate may be formed with two side walls by bending opposite lateral edges of the base plate, and the reinforcing portions may extend inwardly substantially in L shape from the standing ends of the pair of side walls with the facing surfaces thereof held in contact. This configuration prevents the side walls from being inclined inwardly.

Accordingly, a terminal fitting can be provided which can prevent an end portion of a wire from becoming wider.

These and other objects, features and advantages of the present invention will become more apparent upon reading of the following detailed description of preferred embodiments and accompanying drawings. It should be understood that even though embodiments are separately described, single features thereof may be combined to additional embodiments.

DETAILED DESCRIPTION OF THE PREFERRED EMBODIMENTS

Figure 1:
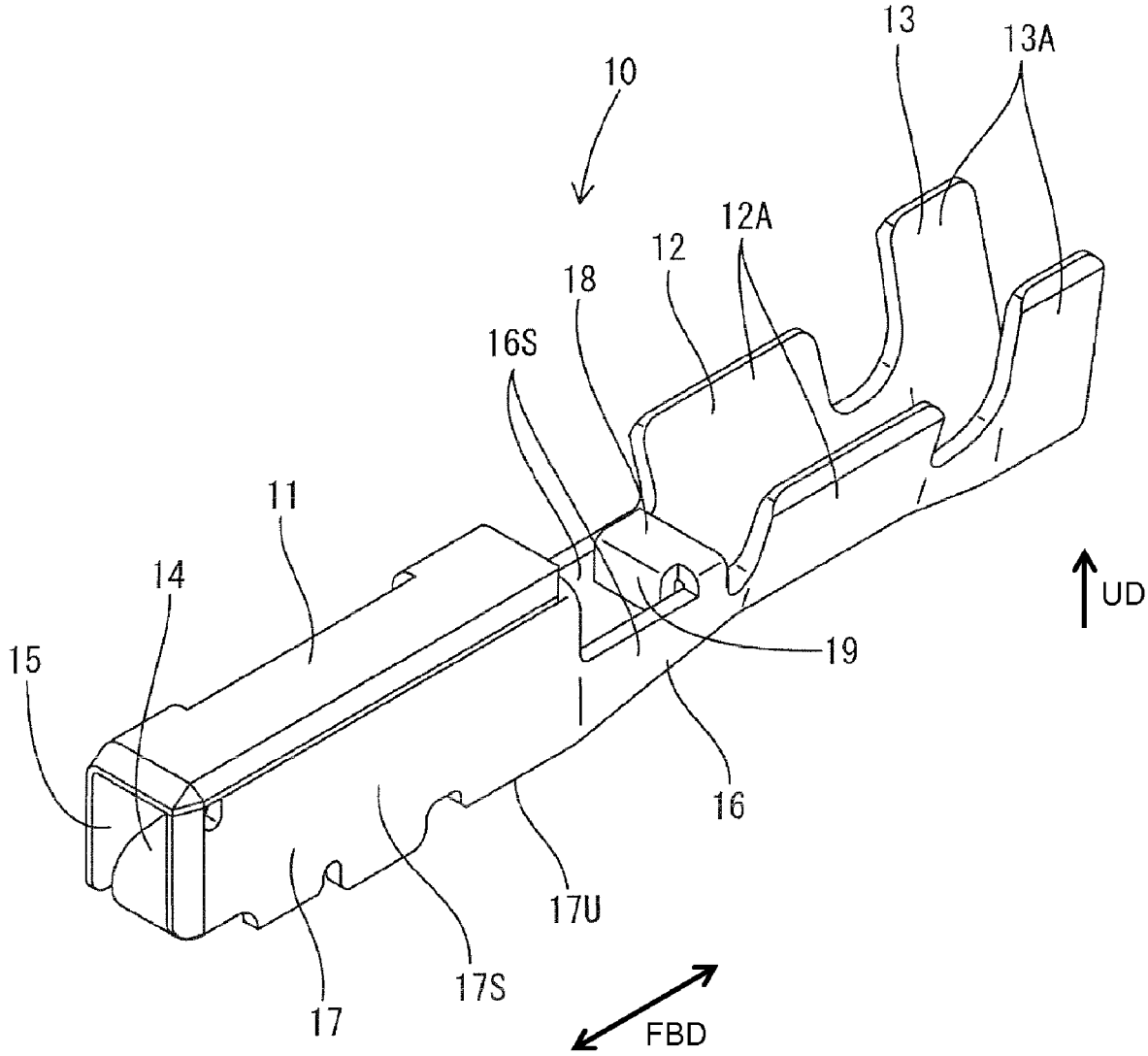
FIG. 1 is a perspective view of a terminal fitting according to a first embodiment.

A female terminal fitting in accordance with a first embodiment of the invention is identified by the numeral 10 in FIGS. 1 to 5. The terminal fitting 10 is formed by punching, stamping or cutting a substantially flat conductive metal plate out into a specified developed shape preferably by using a press forming machine. The cut or punched out metal plate then is bent, folded and/or embossed. The terminal fitting 10 includes a connecting portion 11 to be connected with a mating male terminal fitting (not shown), a wire barrel 12 and an insulation barrel 13 successively formed behind the connecting portion 11. In the following description, upper, lower, left-lower and right-upper sides of FIG. 1 are referred to as upper, lower, front and rear sides.

The connecting portion 11 is formed by bending into a substantially rectangular tube that is long in forward and backward directions FBD and includes a resilient contact piece 14 inside. A tab (not shown) of the mating male terminal fitting can be inserted through an opening 15 in the front end to contact the resilient contact piece 14.

A bottom plate 16 is provided behind and adjacent to the connecting portion 11 and can receive an end portion of a wire 20. The bottom plate 16 is long in forward and backward directions FBD and extends back from a bottom wall 17U at the lower side of surrounding walls 17 of the connecting portion 11. Side walls 16S are bent up at substantially 90° from the opposite lateral edges of the bottom plate 16 and extend substantially parallel with an extending direction of the bottom plate 16. Front ends of the side walls 16S are connected with standing walls 17S of the surrounding walls 17 of the connecting portion 11 substantially facing each other in a short side direction. The standing walls 17S stand up at an angle from the opposite lateral edges of the bottom wall 17U with respect to the short side direction. The upper edges of the side walls 16S are substantially in the vertical center of the connecting portion 11.

The wire barrel 12 is spaced back by a specified distance from the connecting portion 11. The wire barrel 12 is to be crimped, bent or folded into connection with a core 22 of the wire 20. The core 22 projects from an end of an insulation coating 23 at the end of the wire 20 that is placed on the bottom plate 16. The wire barrel 12 has two crimping pieces 12A that project sideways from the opposite lateral edges of the bottom plate 16 in the developed shape of the terminal fitting 10 shown in FIG. 2. The terminal fitting 10 then is formed by bending so that the crimping pieces 12A of the wire barrel 12 stand at a specified distance from each other, as shown in FIG. 1, before being crimped, bent or folded into connection with the wire 20.

The insulation barrel 13 is spaced back from the wire barrel 12 and is to be crimped, bent or folded into connection with the insulation coating 23 of the wire 20 placed on the bottom plate 16. Similar to the wire barrel 12, the insulation barrel 13 has two crimping pieces 13A that project sideways from the opposite lateral edges of the bottom plate 16 in the developed shape of the terminal 10 shown in FIG. 2. The terminal fitting 10 then is formed by bending so that the crimping pieces 13A of the insulation barrel 13 stand at a specified distance from each other, as shown in FIG. 1, before being crimped, bent or folded into connection with the wire 20.

Figure 2:
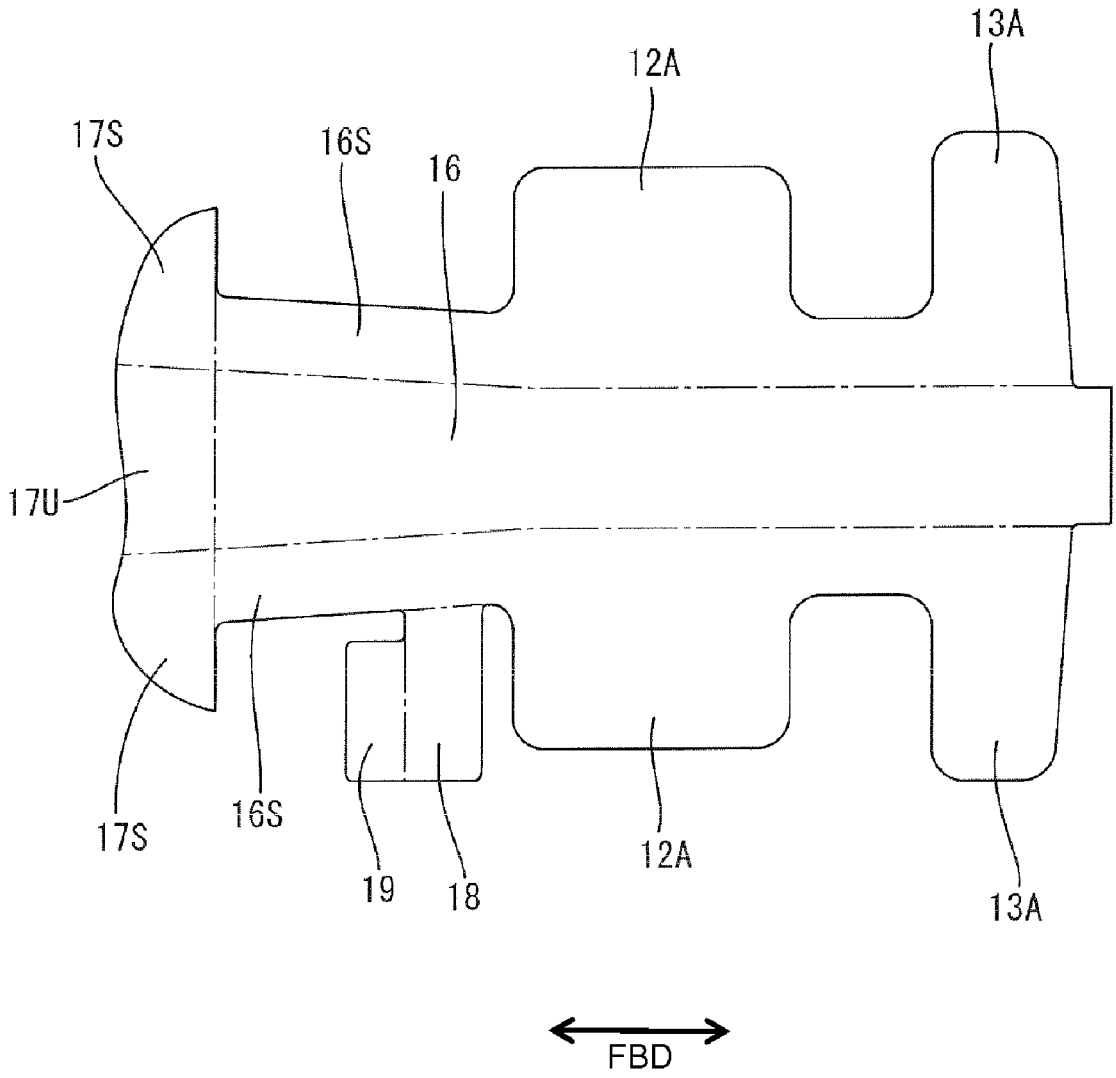
FIG. 2 is a partial plan view showing a developed shape of the terminal fitting.
Figure 3:
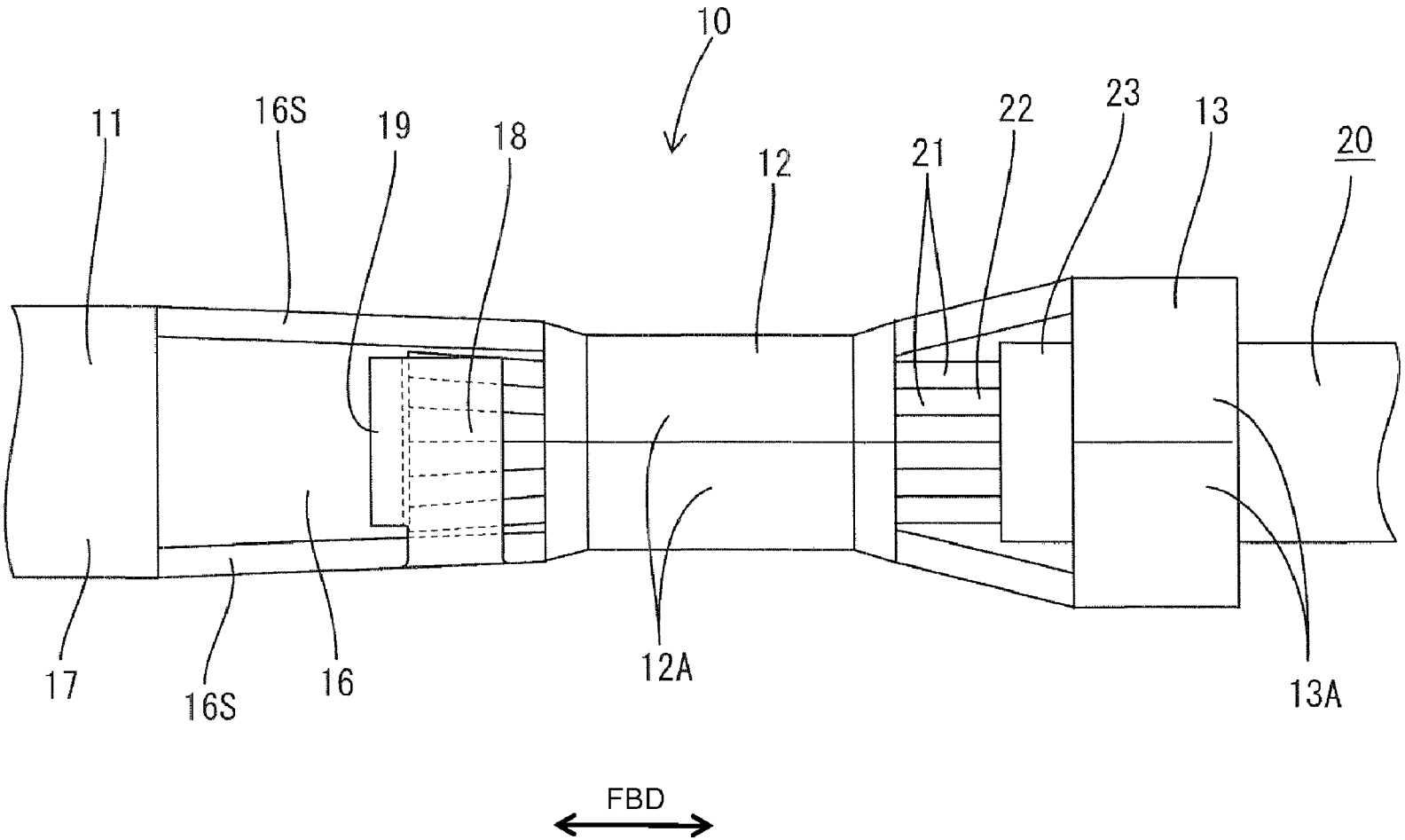
FIG. 3 is a plan view partly in section showing a state where the terminal fitting is connected with an end portion of a wire.
Figure 4:
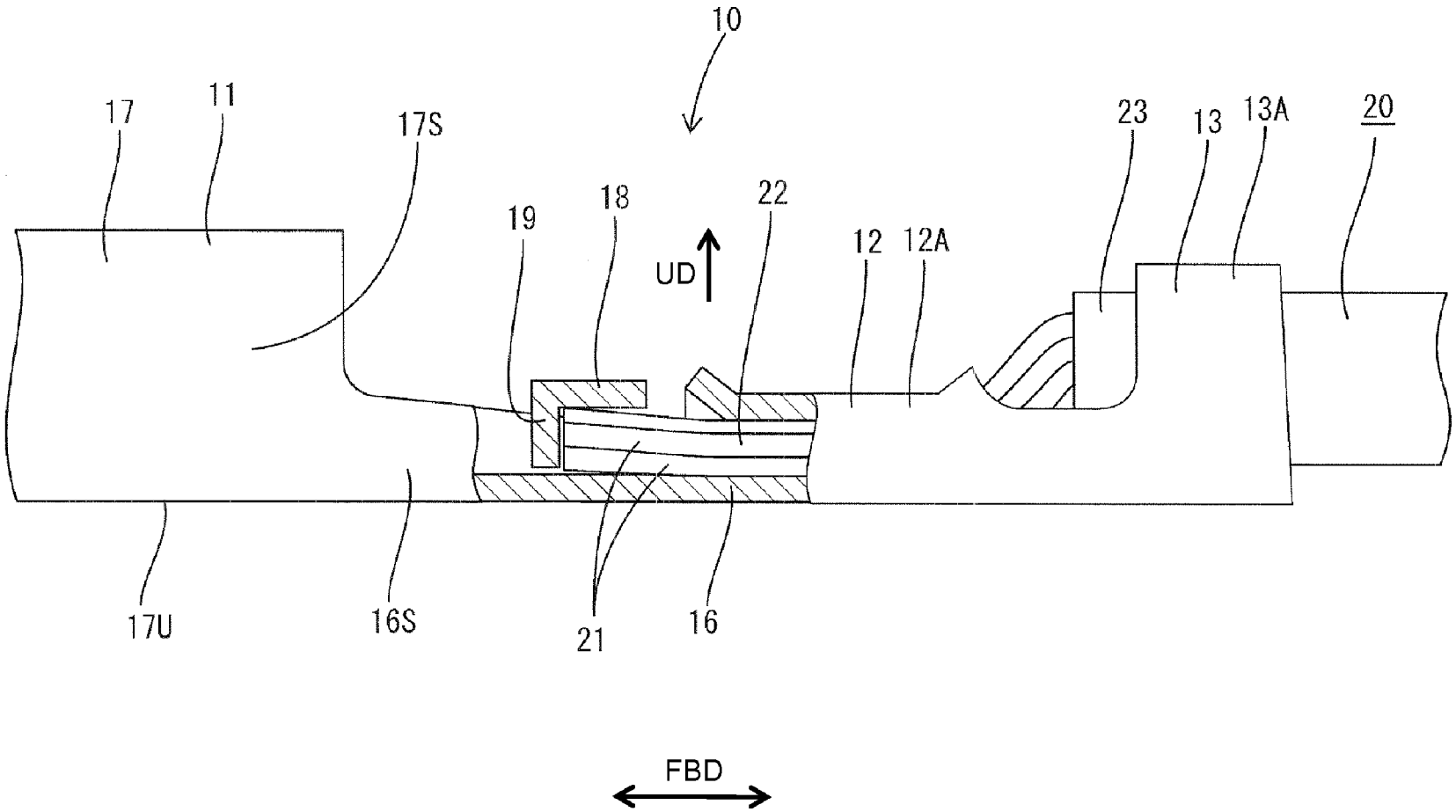
FIG. 4 is a side view partly in section showing the state of FIG. 3.
Figure 5:
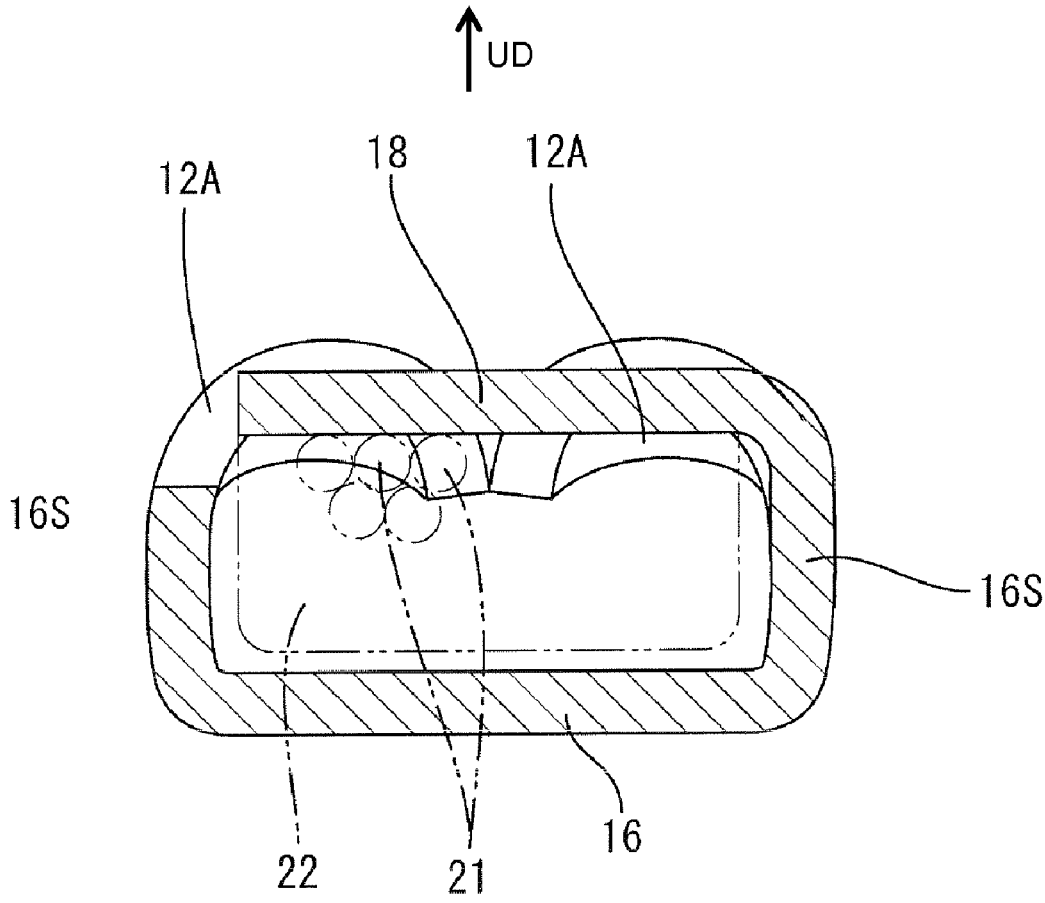
FIG. 5 is a conceptual diagram showing a state where the widening of a core is restricted by a restricting portion.

A restriction 18 is provided between the wire barrel 12 and the connecting portion 11 at a position close to the wire barrel 12 and facing the upper surface of the bottom plate 16. In the developed shape, the restriction 18 projects sideways from one of the opposite lateral edges of the bottom plate 16 and has a substantially rectangular shape that is long in a projecting direction from the bottom plate 16, as shown in FIG. 2. A dimension of the restriction 18 in its extending direction is substantially equal to a width of the bottom plate 16 after being formed by bending.

The restriction 18 is bent at a substantially right angle from one of the opposite side walls 16S that extend from the bottom plate 16. Thus, the restriction 18 is substantially parallel to the bottom plate 16 and faces the upper surface of the bottom plate 16 on which the end portion of the wire 20 is to be placed (see FIGS. 4 and 5). A free end edge of the restriction 18 at a side opposite to the side connected with the side wall 16S reaches the vicinity of the top edge of the opposite side wall 16S while crossing in the short direction above the bottom plate 16 (see FIG. 3).

A front stop 19 projects unitarily forward from the front edge of the restriction 18 (edge toward the connecting portion 11) in the developed shape, as shown in FIG. 2. The front stop 19 is substantially rectangular, but is smaller than the restriction 18. More particularly, the front stop 19 has a long dimension or length that is substantially parallel to the long dimension of the restriction 18. A projecting distance of the front stop 19 from the restriction 18 is substantially equal to vertical dimensions of the side walls 16S. The length of the front stop 19 in the lateral direction of the terminal fitting 10 is less than the corresponding dimension of the restriction 18 by a dimension necessary to bend the restriction 18 and also is less than a distance between the side walls 16S. Edges of the restriction 18 and the front stop 19 opposite the bottom plate 16 are substantially straight.

The front stop 19 is bent down toward the bottom plate 16 at a substantially right angle from the front edge of the restriction 18 and is between the restriction 18 and the bottom plate 16. The bottom end of the bent front stop 19 is close to the bottom plate 16 so that the front stop 19 closes the front of a space between the restriction 18 and the bottom plate 16.

The wire 20 in this exemplary case is an aluminum wire 20 with a core 22 formed by twisting many strands 21 made of aluminum or aluminum alloy. The core 22 is covered by an insulation coating 23. However, the insulation coating 23 is stripped off at the end portion of the aluminum wire 20 to expose the core 22.

The end portion of the aluminum wire 20 is placed on the bottom plate 16 and moved forward until the front end of the core 22 contacts the front stop 19. Thus, an end portion of the insulation coating 23 of the aluminum wire 20 is between the crimping pieces 13A of the insulation barrel 13, an exposed part of the core 22 is between the crimping pieces 12A of the wire barrel 12, and the leading end of the core 22 is between the bottom plate 16 and the restricting portion 18. In this way, the aluminum wire 20 is at a proper position where the leading end of the exposed core 22 projects forward from the wire barrel 12 and the exposed part of the core 22 is inserted over the entire length of the wire barrel 12 in forward and backward directions FBD.

The insulation and wire barrels 13 and 12 then are successively crimped, bent or folded using unillustrated jigs, such as an anvil and a crimper. The insulation barrel 13 is crimped to wind at least partly around the insulation coating 23.

The wire barrel 12 is crimped so that the leading ends of the crimping pieces 12A are bent toward the bottom plate 16 and bite in at substantially widthwise central positions of the upper surface of the core 22. The core 22 preferably is made of aluminum or aluminum alloy, and thus the crimping pieces 12A must break an oxide film of the core 22. Hence the core 22 must be tightened with a stronger force than if the wire barrel 12 is crimped into connection with a core made of copper or copper alloy. The crimping force of the wire barrel 12 urges the part of the core 22 forward of the wire barrel 12 up and away from the bottom plate 16. However, the restriction 18 covers the leading end of the core 22 from above. Thus, the restriction 18 contacts the leading end portion of the core 22 and prevents the core 22 from bending up (see FIGS. 4 and 5). In this way, the terminal fitting 10 is connected with the aluminum wire 20 without the leading end portion of the core 22 being bent in an upward direction UD away from the bottom plate.

The restriction 18 faces the upper surface of the bottom plate 16 before the wire barrel 12 of the terminal fitting 10. The leading end portion of the core 22 is inserted between the bottom plate 16 and the restriction 18 and then the wire barrel 12 is crimped, bent or folded. The restriction 18 prevents the leading end of the core 22 from being bent in the upward direction UD. Therefore, the core 22 of the wire 20 is prevented from being bent up away from the bottom plate 16.

The front stop 19 is between the restriction 18 and the bottom plate 16. The front end of the core 22 contacts the front stop 19 at a proper position with the exposed leading end portion of the core 22 projecting forward from the wire barrel 12. If the wire barrel 12 is crimped without the wire 20 being at the proper position, i.e. with the core 22 retracted back from the front end of the wire barrel 12, a contact area of the wire barrel 12 and the core 22 decreases to increase contact resistance. However, the wire 20 is set reliably at the proper position when the front end of the core 22 contacts the front stop 19. Therefore, the wire 20 easily can be arranged at the proper position and contact resistance is not increased.

The restriction 18 preferably is formed by being bent at the lateral edge of the bottom plate 16 to extend substantially toward the side facing the bottom plate 16, and/or the front stop 19 is formed by being bent at the front edge of the restriction 18 to extend toward the bottom plate 16. If the restriction or the front stop is formed by cutting and bending the bottom plate, an opening is formed in the bottom plate and the strength of the terminal fitting is reduced by that much. However, the terminal fitting 10 is not reduced since no such opening is formed.

It is also possible to employ, for example, the following modes in the first embodiment.

The operation of connecting the terminal fitting 10 with the end portion of the aluminum wire 20 is described in the first embodiment. However the terminal fitting may be connected with an end portion of a wire including a core made of copper or copper alloy. In this case as well, effects similar to the above can be obtained.

The restriction 18 is substantially parallel to the bottom plate 16 in the first embodiment. However, the restricting portion need not be substantially parallel to the bottom plate provided that it is facing the bottom plate. For example, the restricting portion may be inclined to gradually approach the bottom plate toward the projecting end.

The end edge of the restriction 18 at the side opposite to the side connected with the bottom plate 16 reaches the vicinity of the other lateral edge of the bottom plate 16 in the first embodiment. However, it may not necessarily reach the vicinity of the other lateral edge and may, for example, stop at a position slightly beyond a substantially central position of the bottom plate.

The restriction 18 is formed by being bent at one of the opposite lateral edges of the bottom plate 16 in the first embodiment. However, two restrictions may be provided at the opposite lateral edges of the bottom plate and may be bent to extend from these lateral edges toward the center of the bottom plate in the short side direction.

The front stop 19 is bent at the front edge of the restriction 18 to extend toward the bottom plate 16 in the first embodiment. However, the front stop portion may be formed by cutting and bending the bottom plate. Thus, the front stop may be provided, for example, at an intermediate position of the restriction in forward and backward directions.

The restriction 18 is bent at the lateral edge of the bottom plate 16 in the first embodiment. However, the front stop may be formed, for example, by cutting and bending the bottom plate and the restriction may be formed by being bent back at the upper edge of the front stop formed by cutting and bending.

Figure 6:
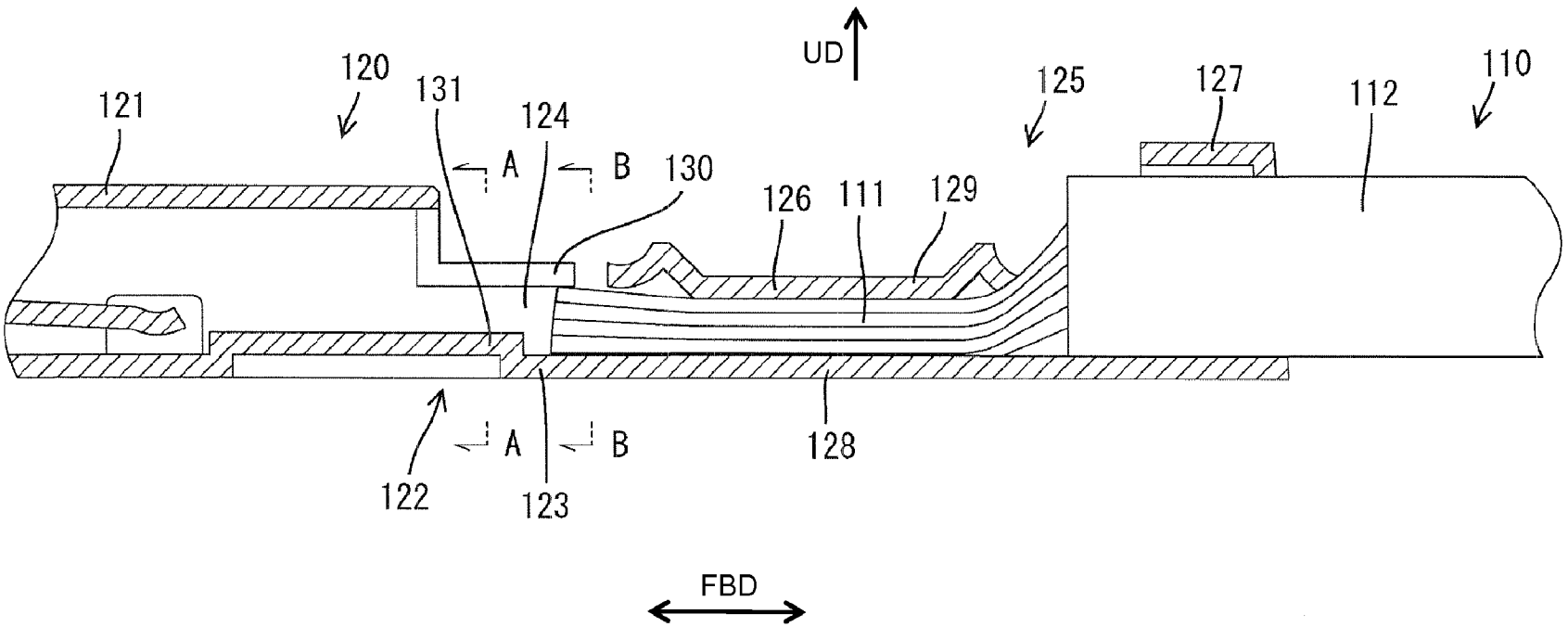
FIG. 6 is a section of a terminal fitting according to a second embodiment.
Figure 7:
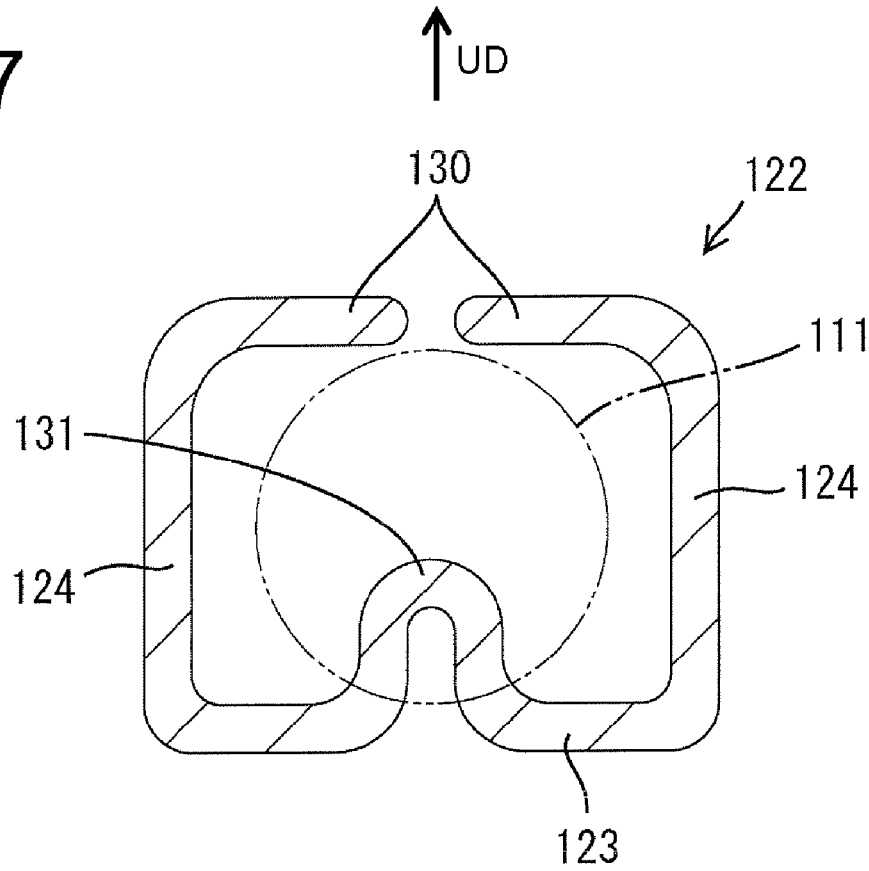
FIG. 7 is a section along A-A of FIG. 6.
Figure 8:
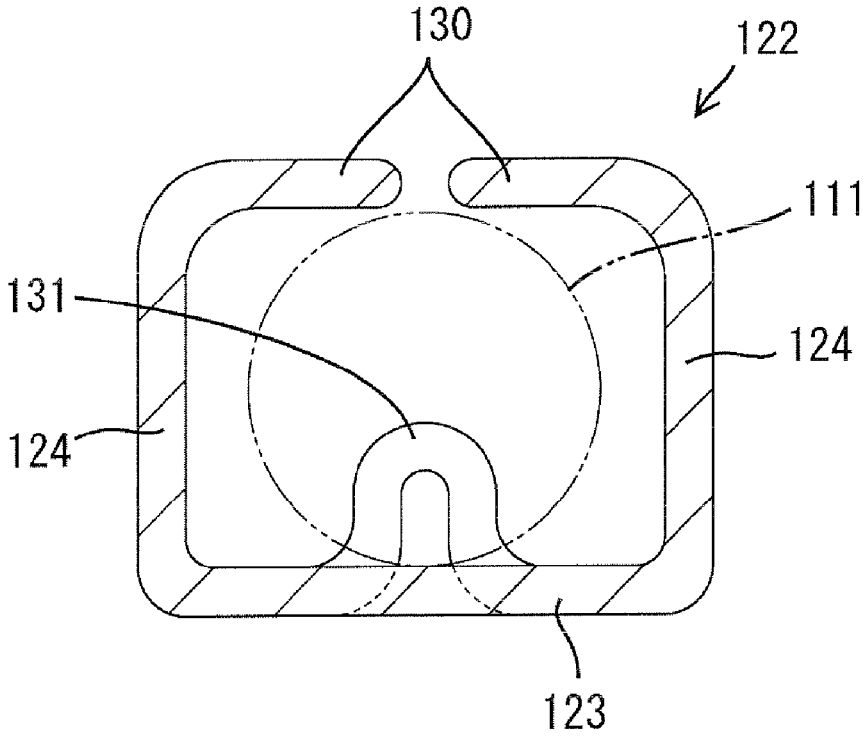
FIG. 8 is a section along B-B of FIG. 6.

A wiring harness of a second embodiment is illustrated in FIGS. 6 to 8. The wiring harness of the second embodiment has a wire 110 and a terminal fitting 120 connected electrically with a front end portion (left end in FIG. 6) of the wire 110. The wire 110 has a conductor 111 and an insulation coating 112 that surrounds the conductor 111. The insulation coating 112 is removed at the front end portion of the wire 110 to expose a front end portion of the conductor 111 for connection with the terminal fitting 120. The conductor 111 preferably is made of thin copper or aluminum wires that are twisted to form a core. Aluminum is more rigid than copper, but has lower electrical conductivity.

The terminal fitting 120 is a female terminal fitting formed by bending a conductive metal plate that has been punched or cut out into a specified shape. A rectangular tubular connecting portion 121 is formed at the front end of the terminal fitting 120 and a wire crimping portion 125 in the form of an open barrel is at the rear end of the terminal fitting 120. The connecting portion 121 has a known form and functions as a connecting means with a long narrow tab (not shown) of a mating male terminal.

A coupling 122 couples the rear end of the connecting portion 121 and the front end of the wire crimping portion 125. The coupling 122 has a bottom plate 123 and laterally symmetrical side walls 124 stand up at substantially right angles from the opposite left and right sides of the bottom plate 123. An upwardly open space is formed in the coupling 122.

The wire crimping portion 125 includes a wire barrel 126 connected with the rear end of the coupling 122 and an insulation barrel 127 behind the wire barrel 126. An automatic machine called an applicator then is used to crimp, bend or fold the insulation barrel 127 into connection with a part of the front end portion of the wire 110 insulated with the insulation coating 112 surrounding the conductor 111. Simultaneously, the applicator also crimps, bends or folds the wire barrel 126 into connection with the conductor 111. Thus, the insulation barrel 127 surrounds and presses the wire 110 and is fixed to the insulation barrel 127 by a fixing force produced by this pressing.

The wire barrel 126 has a base plate 128 continuous with the bottom plate 123 of the coupling 122 and two laterally symmetrical crimping pieces 129 extend from the opposite left and right sides of the base plate 128. The wire barrel 126 is crimped, bent or folded into electrical connection with the conductor 111 exposed by removing the insulation coating 112 at the front end portion of the wire 110. More particularly, the wire crimping portion 125 is set on an anvil (not shown) of an automatic machine with the conductor 111 set on the base plate 128. A crimper (not shown) then is lowered to wind the crimping pieces 129 around the conductor 111. In this way, the base plate 128 and the crimping pieces 129 are crimped to surround and press the conductor 111.

The front end portion of the crimped conductor 111 projects forward from the front end edges of the crimping pieces 129 and is accommodated in a space adjacent the bottom plate 123 of the coupling 122. A strong tightening of the wire barrel 126 may cause the twisted thin metal wires of the conductor 111 to loosen up and the front end portions of the loosened-up thin metal wires are deformed to become wider.

Accordingly, the coupling 122 has two laterally symmetrical restrictions 130 for preventing the front end portion of the conductor 111 from widening. The restrictions 130 extend in from the standing ends of side walls 124 so that the restrictions 130 are substantially parallel to the bottom plate 123 and face the upper surface of the bottom plate 123. Thus, the restrictions 130 cover the front end portion of the conductor 111 that projects forward from the wire barrel 126. The restrictions 130 are at substantially the same height as the uppermost ends of the crimping pieces 129 of the crimped wire barrel 126.

The front end portion of the conductor 111 is located before the wire barrel 126 when the wire barrel 126 is crimped in connection with the conductor 111. Thus, the front end portion of the conductor 111 may be widened during the crimping operation. However, the coupling portion 122 is formed with the substantially eave-like restrictions 130 that press the front end portion of the conductor 111 from above to restrict the widening or displacement of the front end portion of the conductor 11.

The coupling 122 is connected directly with the wire barrel 126 and may be deformed by a strong tightening of the wire barrel 126. More particularly, the coupling 122 may have low rigidity and may be influenced easily by the tightening of the wire barrel 126 due to the upwardly open box shape formed by the bottom plate 123 and the side walls 124 that stand up from the opposite left and right edges of the bottom plate 123. Accordingly, the coupling 122 has at least one reinforcement 131. More particularly, at least one widthwise intermediate part of the bottom plate 123 is hammered up to form the reinforcement 131 as an upwardly projecting rib. The reinforcement 131 extends continuously straight in forward and backward directions from a position slightly before the front end of the conductor 111 to a bottom wall of the connecting portion 121.

The reinforcement 131 increases the bending rigidity of the bottom plate 123. Thus, the coupling 122 is less likely to be deformed by the tightening of the wire barrel 126.

Figure 9:
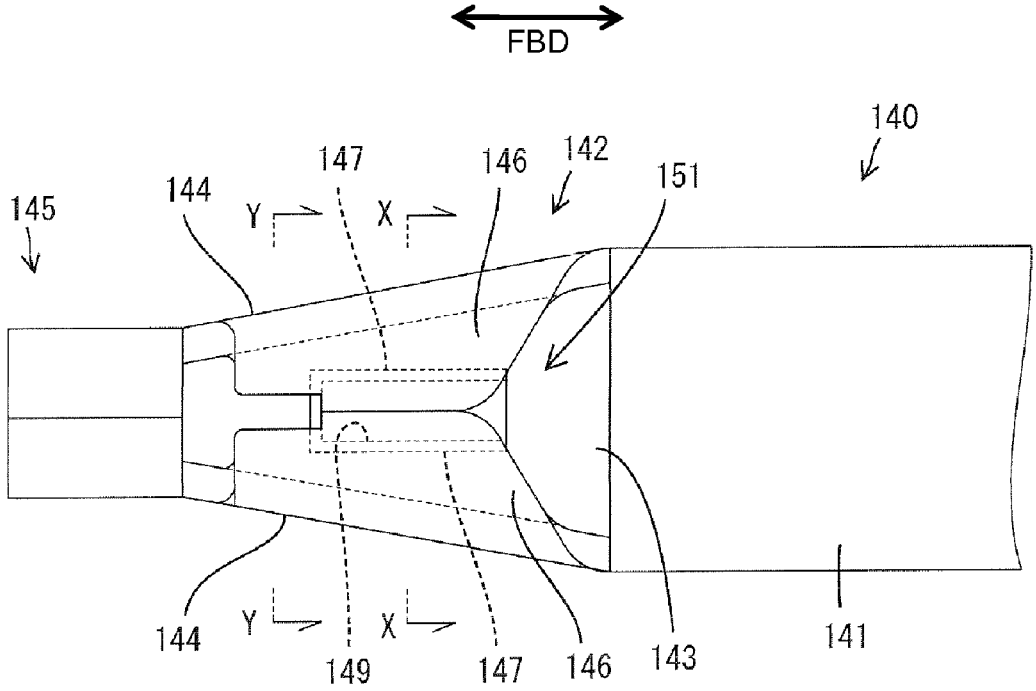
FIG. 9 is a partial enlarged plan view of a terminal fitting according to a third embodiment.
Figure 10:
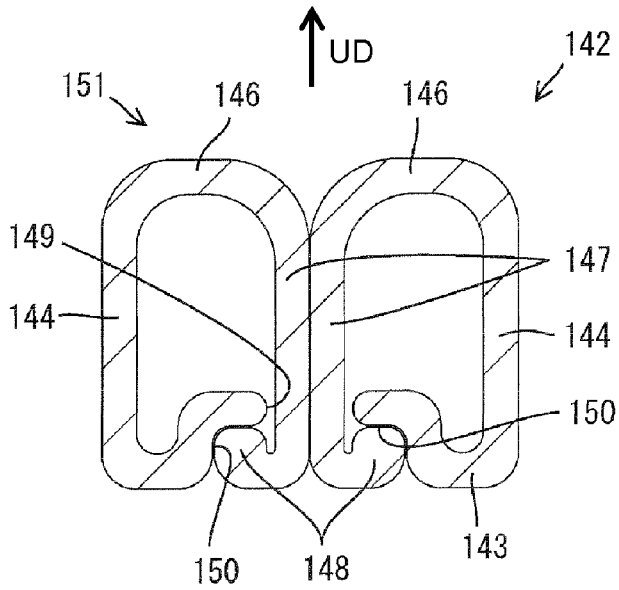
FIG. 10 is a section along X-X of FIG. 9.
Figure 11:
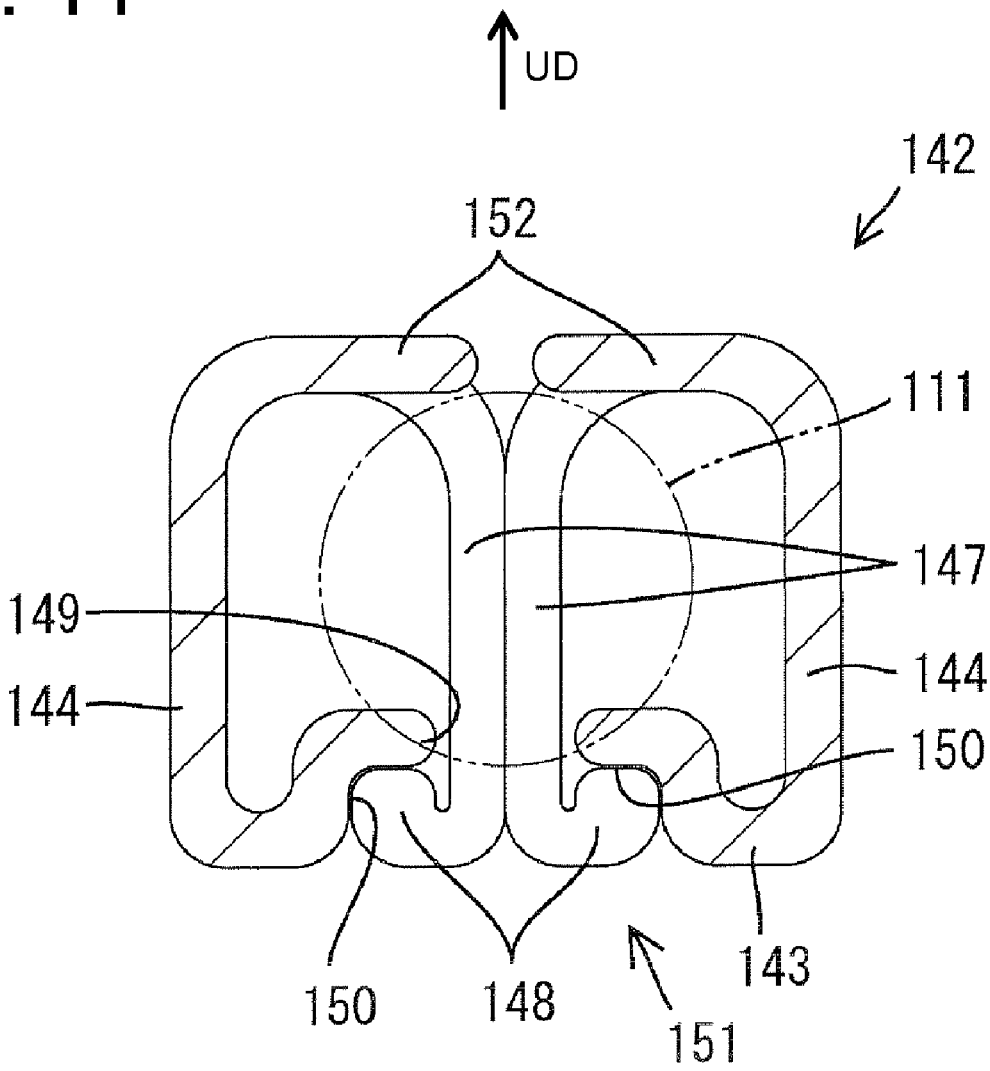
FIG. 11 is a section along Y-Y of FIG. 9.

A wiring harness according to a third embodiment of the invention is illustrated in FIGS. 9 to 11. The wiring harness of the third embodiment differs from the second embodiment in the construction of a terminal fitting 140. Elements of the third embodiment that are similar to or the same as in the second embodiment are identified by the same reference numerals, but are not described again.

The terminal fitting 140 of the third embodiment has a coupling 142 formed between a connecting portion 141 and a wire crimping portion 145. The coupling 142 has two laterally symmetrical restrictions 152 and two laterally symmetrical reinforcements 151. Two horizontal extensions 146 are formed at the standing ends of left and right walls 144 of the coupling 142 and extend in substantially parallel to a bottom plate 143. Two extensions 147 extend down from front ends of the horizontal extensions 146 toward the bottom plate 143 and are substantially parallel to the side walls 144. The facing surfaces of the downward extensions 147 are held laterally in close contact with each other. Bottom ends of the downward extensions 147 are bent toward the side walls 144 to form locking projections 148.

A locking hole 149 vertically penetrates the bottom plate 143 at a widthwise central position and is long in forward and backward directions FBD. Portions of the bottom plate 143 on opposite left and right sides of the locking hole 149 are raised up to form steps that are higher than parts of the bottom plate 143 close to the side walls 144. Thus, recesses 150 are formed on the lower surface of the bottom plate 143 at opposite left and right sides of the locking hole 149.

The bottom ends of the downwardly extensions 147 are fit into the locking hole 149 and the locking projections 148 are accommodated in the recesses 150. Upon forming the coupling 142, the downward extensions 147 are inserted into the locking hole 149 without forming the locking projections 148 and, thereafter, the locking projections 148 are formed by bending. The front end regions of the horizontal extensions 146, the downward extensions 147, the locking hole 149, the locking projections 148 and the recesses 150 constitute the reinforcements 151.

Forward, backward, leftward and rightward displacements of the downward extensions 147 relative to the bottom plate 143 are restricted by the engagement of the locking hole 149 and the downward extensions 147. Upward displacements of the downward extensions 147 relative to the bottom plate 143 (i.e. displacements in the upward direction UD) are restricted by the engagement of the locking projections 148 and the recesses 150. Lateral displacements of the side walls 144 are restricted by the contact of the downward extensions 147. The restricting construction increases bending rigidity of the coupling 142 to prevent deformation of the coupling 142.

Restrictions 152 are defined at rear end regions of the horizontal extensions 146. The restrictions 152 project forward from the wire barrel, similar to the second embodiment, and are positioned to cover the conductor 111 of the wire 110 accommodated in the coupling 142 to prevent the conductor 111 from being widened.

Figure 12:
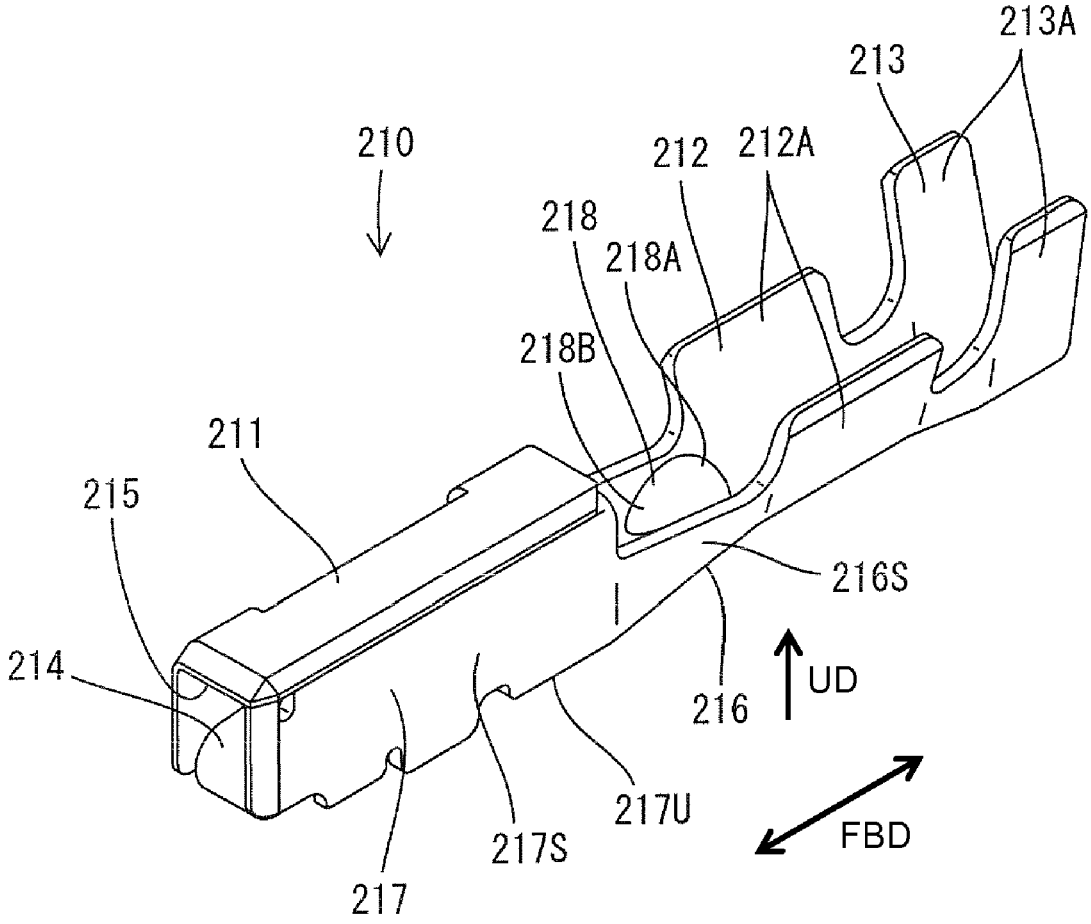
FIG. 12 is a perspective view of a terminal fitting according to a fourth embodiment.
Figure 13:
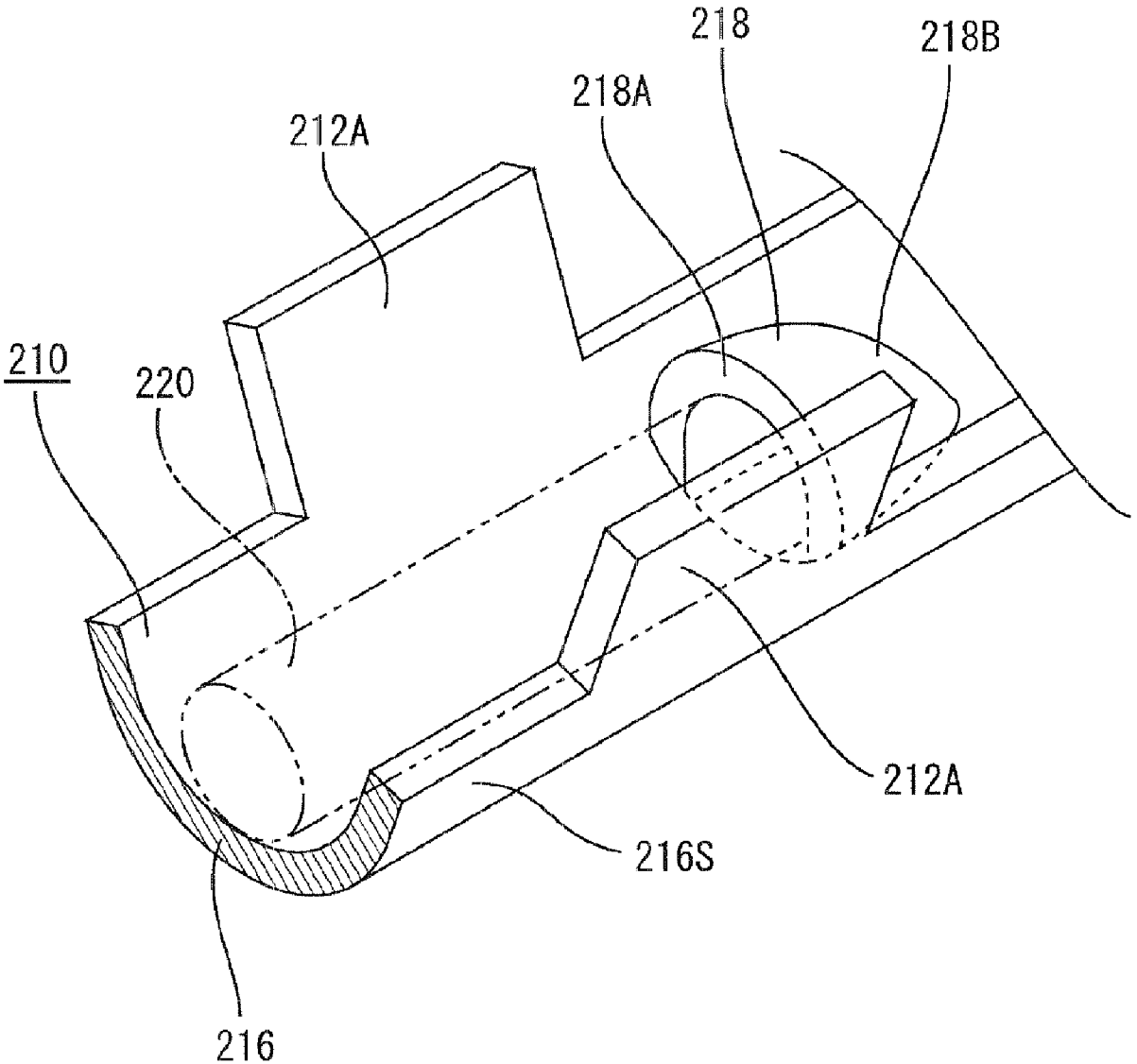
FIG. 13 is a partial enlarged perspective view of the terminal fitting.
Figure 14:
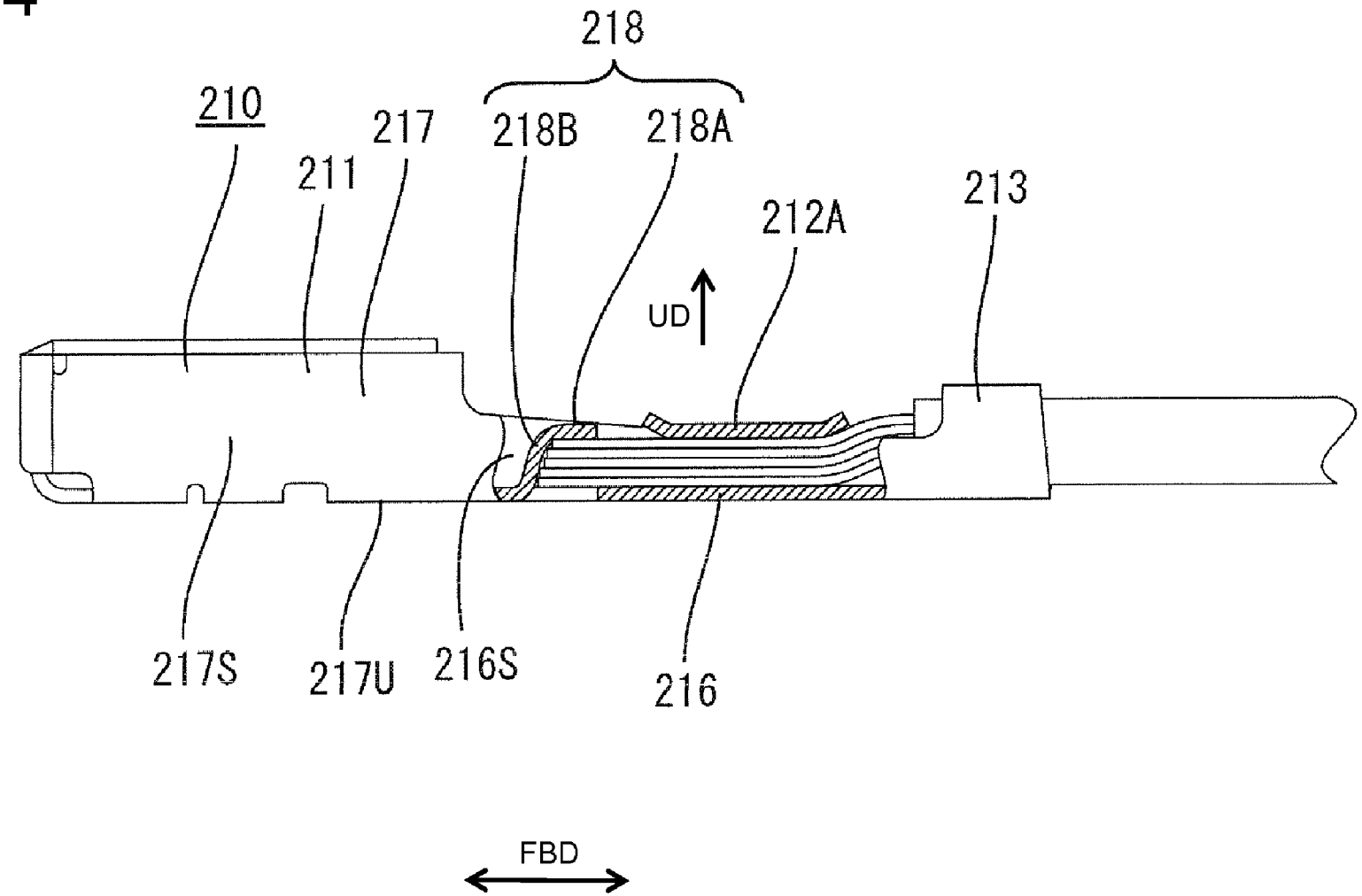
FIG. 14 is a side view partly in section showing a state where the terminal fitting is connected with an end portion of a wire.

A female terminal in accordance with a fourth embodiment is identified by the numeral 210 in FIGS. 12 to 14. The terminal fitting 210 is formed by bending a conductive metal piece obtained by punching, stamping or cutting a flat conductive metal plate into a specified developed shape by using a press forming machine. The terminal fitting 210 includes a connecting portion 211 to be connected with a mating terminal (not shown). A wire barrel 212 and an insulation barrel 213 are formed successively behind the connecting portion 211. In the following description, upper, lower, left-lower and right-upper sides of FIG. 12 are referred to as upper, lower, front and rear.

The connecting portion 211 is formed by bending to define a substantially rectangular tube that is long in forward and backward directions FBD. A resilient contact piece 214 is inside the connecting portion 221. A tab (not shown) of the mating male terminal fitting can be inserted through an opening 215 in the front of the connecting portion 221 to contact the resilient contact piece 214.

A bottom plate 216 is provided adjacent to and behind the connecting portion 211 and can receive an end portion of a wire 220. The bottom plate 216 extends back from a bottom wall 217U at the lower side of surrounding walls 217 of the connecting portion 211 and is long in forward and backward directions FBD. Side walls 216S are bent up at substantially right angles from the opposite lateral edge sides of the bottom plate 216 and extend in a longitudinal direction substantially parallel with an extending direction of the bottom plate 216. The front ends of the side walls 216S of the bottom plate 216 are connected with standing walls 217S of the connecting portion 211. The standing walls 217S stand up from the opposite lateral sides of the bottom wall 217U and face each other in a short side direction. Upper edges of the side walls 216S are substantially in the center of the connecting portion 211 with respect to a vertical direction.

The wire barrel 212 is spaced back from the connecting portion 211 by a specified distance. The wire barrel 212 is to be crimped, bent or folded into connection with a core 222 projecting from an end of an insulation coating 223 at the end portion of the wire 220 placed on the bottom plate 216. The wire barrel 212 has crimping pieces 212A that project from the opposite lateral sides of the bottom plate 216. The crimping pieces 212A stand while substantially facing each other, as shown in FIG. 12, after the terminal fitting 210 is formed, but prior to crimping.

The insulation barrel 213 is spaced back from the wire barrel 212 and is to be crimped, bent or folded into connection with the insulation coating 223 of the wire 220 that has been placed on the bottom plate 216. Similar to the wire barrel 212, the insulation barrel 213 has two crimping pieces 213A that project from the opposite lateral sides of the bottom plate 216. The crimping pieces 213A stand while substantially facing each other, as shown in FIG. 12, after the terminal fitting 210 is formed, but prior to crimping.

The terminal fitting 210 has a restriction 218A for receiving the end portion of the wire 220 and a front stop 218B that contacts the end of the wire 220. The restriction 218A faces the upper surface of the bottom plate 216 and is located before the wire barrel 212. The front stop 218B is located before the restriction 218A. The restriction 218A is a rear part of a bulge 218 formed by hammering a part of the bottom plate 216 before the wire barrel 212 from the lower side to project up toward the side where the end portion of the wire 220 is to be placed. The front stop 218B is a front part of the bulge 218. In other words, the restriction 218A and the front stop 218B are formed unitarily.

The bulge 218 is formed at a widthwise central position of the bottom plate 216 and the substantially entire periphery of the bulge 218 except the rear edge is connected with the bottom plate 216. Only the rear edge of the bulge 218 is separated from the bottom plate 216. Thus, the bulge 218 preferably has a dome shape only open at the rear (see FIG. 13). The projecting distance of the bulge 218 gradually decreases from the rear end toward the front, and the projecting height of the bulge 218 at the rear end is at least as high as the upper edges of the opposite side walls 216S (see FIG. 14).

The restriction 218A is defined by the rear part of the bulge 218 and has an arched shape so that the leading end of the core 222 is insertable into the restriction 218A from the front. The front stop 218B is defined by the front part of the bulge 218 and is a wall standing up from the bottom plate 216 and closing the restriction 218A.

The wire 220 has a core 222 formed by twisting many strands 221 of aluminum or aluminum alloy. An insulation coating 223 covers the core 222. However, the insulation coating 223 is stripped off at the end portion of the aluminum wire 220 to expose the core 222.

The end portion of the aluminum wire 220 is placed on the bottom plate 216 of the terminal fitting 210 so that the leading end of the core 222 substantially contacts the front stop 218B. Thus, an end portion of the insulation coating 223 is arranged between the crimping pieces 213A of the insulation barrel 213 and an exposed part of the core 222 is arranged between the crimping pieces 212A of the wire barrel 212. Additionally, the leading end of the core 222 is inserted between the restriction 218A and the bottom plate 216. In this way, the aluminum wire 220 is set at a proper position where the exposed part of the exposed core 222 is inserted over substantially the entire length of the wire barrel 212 in forward and backward directions FBD.

The insulation barrel 213 and the wire barrel 212 then are successively crimped, bent or folded using unillustrated jigs, such as an anvil and a crimper. The insulation barrel 213 is crimped, bent or folded to wind at least partly around the insulation coating 223.

The wire barrel 212 is crimped so that the leading ends of the crimping pieces 212A are bent substantially toward the bottom plate 216 and bite in or engage widthwise central positions of the upper surface of the core 222. The core 222 is made of aluminum or aluminum alloy, and must be tightened with a stronger force then the force required for a conventional core made of copper or copper alloy so that the crimping pieces 212A can break an oxide film of the core 222. The crimping force of the wire barrel 212 urges the part of the core 222 forward of the wire barrel 212 up in the upward direction UD and away from the bottom plate 216. However, the leading end portion of the core 222 is between the restricting portion 218A and the bottom plate 216. Thus, the leading end portion of the core 222 is prevented from being bent up in the upward direction UD (see FIG. 14).

The arch-shaped restriction 218A is formed at the part of the bottom plate 216 before the wire barrel 216 in the terminal fitting 210 of the fourth embodiment. The restriction 218A bulges up and has the open rear end so that the leading end of the core 222 can be inserted between the restriction 218A and the bottom plate 216. Further, the restriction 218A is formed at the bottom plate 216 of the terminal fitting 210. A restriction could be formed by bending a bottom plate at a lateral edge to extend above the bottom plate. Thus, a part that functions as the restriction would need to be provided in addition to a connecting portion, the bottom plate and a wire barrel. Accordingly, more material would be necessary. However, the restriction 218A is formed by causing the bottom plate 216 to project up in the fourth embodiment, and it is not necessary to provide a part that functions as the restriction 218A in addition to the connecting portion 211, the bottom plate 216 and the wire barrel 212. Therefore an increase of material cost can be prevented.

The front stop 218B stands up substantially normal to the bottom plate 216 before the restriction 218A and contacts the end of the wire 220. Thus, the end portion of the wire 220 is placed at substantially the proper position between the restriction 218A and the bottom plate 216 by bringing the leading end of the core 222 into contact with the front stop 218B. Therefore, the end portion of the wire 220 easily is positioned in forward and backward directions.

Figure 15:
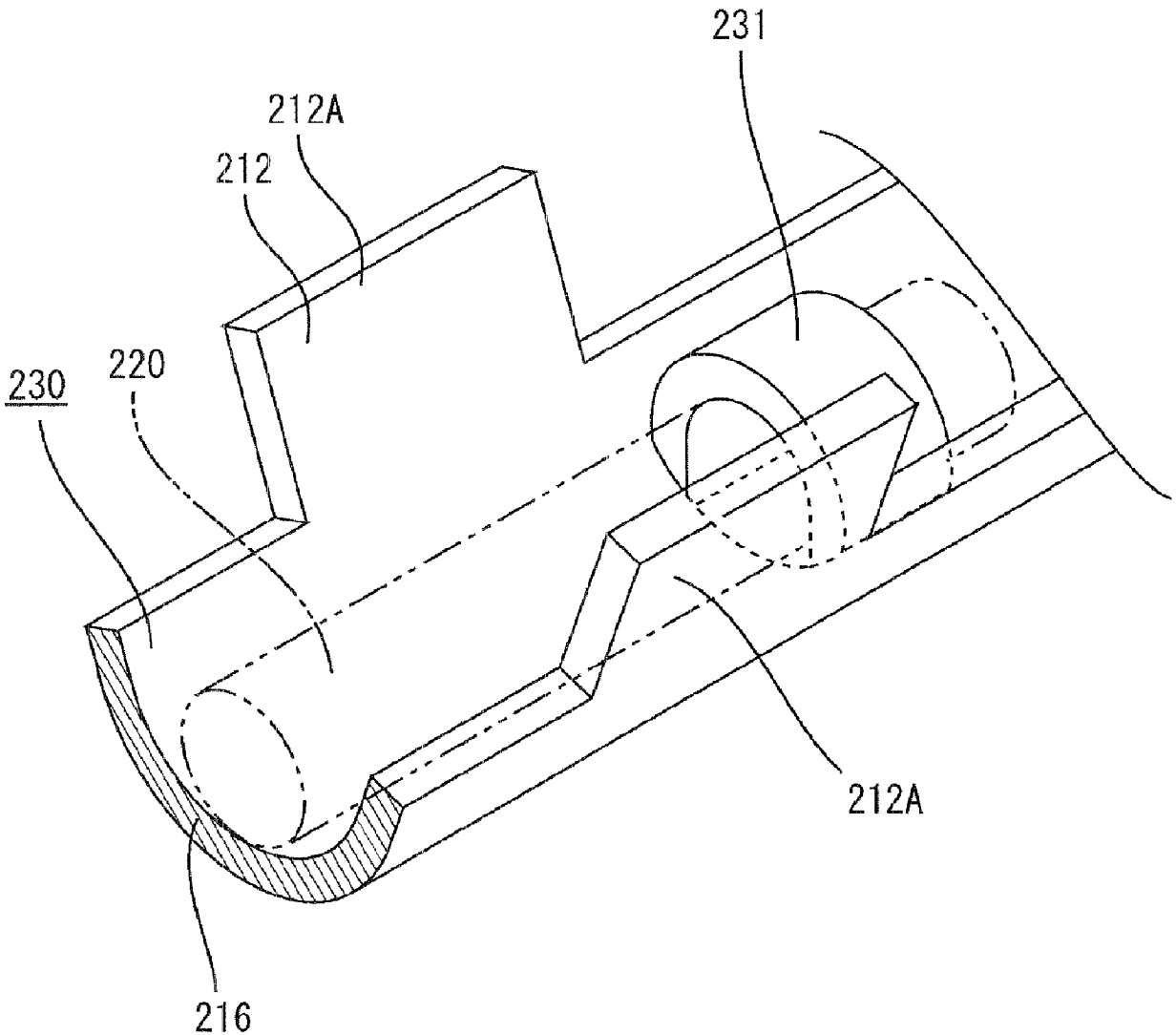
FIG. 15 is a partial enlarged perspective view of a terminal fitting according to a fifth embodiment.
Figure 16:
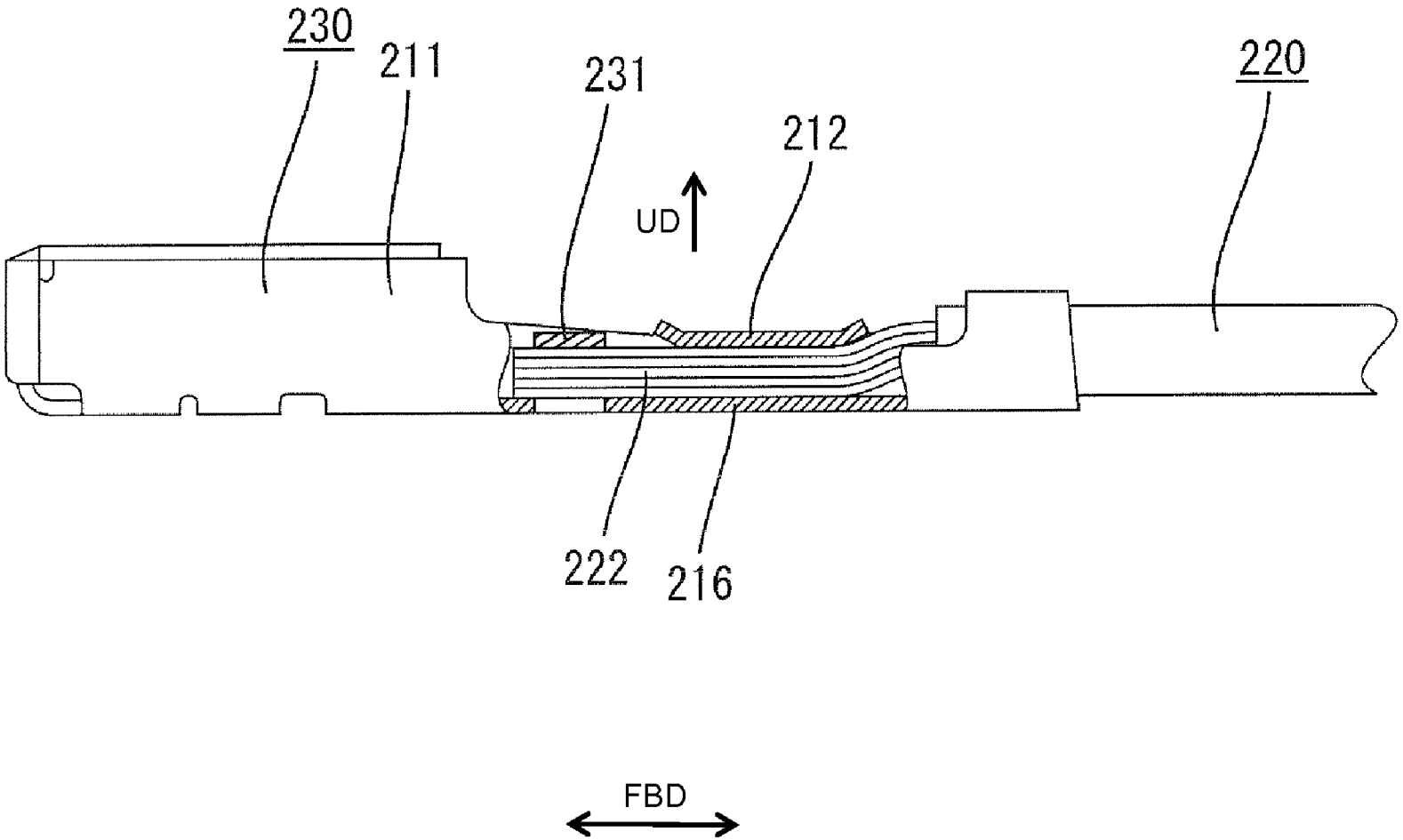
FIG. 16 is a side view partly in section showing a state where the terminal fitting is connected with an end portion of a wire.

A terminal fitting according to a fifth embodiment is identified by the numeral 230 in FIGS. 15 and 16. The terminal fitting 230 of the fifth embodiment has no front stop comparable to the front stop 218B of the fourth embodiment. Constructions similar to or substantially same as the fourth embodiment are identified by the same reference numerals and not repeatedly described.

The terminal fitting 230 includes a connecting portion 211 to be connected with a mating terminal, a bottom plate 216 on which an end portion of a wire 220 is to be placed, and a wire barrel 212 to be crimped, bent or folded into connection with a core 222 similar to the fourth embodiment.

A restriction 231 is provided before the wire barrel 212 and between the connecting portion 211 and the wire barrel 212. The restriction 231 is formed by hammering a part of the bottom plate 216 before the wire barrel 212 to project up toward a side where the end portion of the wire 220 is placed.

The restriction 231 is provided at a widthwise intermediate position of the bottom plate 216 and has an arched or bridge-like shape with open front and rear ends, so that a leading end portion of the core 222 is insertable therein from behind. The openings of the restriction 231 are of substantially the same shape and same size in forward and backward directions FBD. A projecting distance of the restriction 231 is set such that a projecting end of the restriction 231 is located at substantially the same height as or slightly higher than the upper edges of both side walls 216S of the bottom plate 216 (see FIG. 16).

The leading end portion of the core 222 is inserted between the restriction 231 and the bottom plate 216 to prevent the core 222 from being bent up in the upward direction UD in response to crimping the wire barrel 212. Further, there are no additional material costs because the restriction 231 is formed by causing the bottom plate 216 of the terminal fitting 230 to project up.

It is also possible to employ, for example, the following modes in the fourth and fifth embodiments.

The front stop 218B and the restriction 218A are formed unitarily in the fourth embodiment. However, the front stop and the restriction may be formed separately. For example, a part of the bottom plate 216 before the restriction 231 in the terminal fitting 230 of the fifth embodiment may be cut and bent up to form a front stop.

The operation of connecting the terminal fitting 210 with the end portion of the aluminum wire 220 is described in the fourth and fifth embodiments. However, the terminal fitting 210 may be connected with an end portion of a wire including a core made of copper or copper alloy. In this case as well, effects similar to the above can be obtained.

The invention has been described by way of example with respect to female terminal fittings. However, the invention is equally applicable to male terminal fitting to be connected with respective wires.

What is claimed is:

1. A terminal fitting, comprising:

a connecting portion to be connected with a mating terminal;

a wire barrel to be crimped into connection with an end portion of a wire;

a base plate extending between the connecting portion and the wire barrel;

first and second side walls projecting up from opposite first and second lateral sides of the base plate;

at least one restriction arranged between the connecting portion and the wire barrel and substantially facing a placing surface of the base plate, where the end portion of the wire is to be placed the restriction being bent to extend from at least the first side wall toward the second side wall and spaced from the base plate for restricting a movement of the end portion of the wire in a direction substantially away from the base plate; and a front stop extending from the restriction substantially to the base plate and being at a side of the restriction closer to the connecting portion so that the front stop contacts a longitudinal front end of the end of the wire.

2. The terminal fitting of claim 1, wherein the front stop is unitary with the restriction.

3. The terminal fitting of claim 1, wherein at least one reinforcement is formed between the connecting portion and the wire barrel for increasing rigidity of the base plate.

4. The terminal fitting of claim 3, wherein the reinforcement is a rib that extends in forward and backward directions (FBD) along at least part of the connecting portion and projects unitarily from the base plate.

5. The terminal fitting of claim 4, wherein the reinforcements are substantially L-shaped and extend inwardly from ends of the side walls with the facing surfaces thereof held in contact.

6. A terminal fitting for a wire comprising:

a connecting portion to be connected with a mating terminal;

a wire barrel to be crimped into connection with an end portion of a wire;

a base plate extending between the connecting portion and the wire barrel;

first and second side walls projecting up from opposite first and second lateral sides of the base plate;

a restriction bulging out from the base plate centrally between the side walls and between the connection portion and the wire barrel, the restriction being joined unitarily to the base plate at least at two opposed sides and being deformed from the base plate into an arched shape with at least one open end in a forward and backward direction; wherein the restriction is dimensioned to prevent the wire from being bent in an upward direction away from the base plate.

7. The terminal fitting of claim 6, wherein the front end of the restriction is closed to define a front stop.

8. A terminal fitting, comprising:

a connecting portion for connecting with a mating terminal;

a wire barrel configured to be crimped into connection with an end portion of a wire;

a base plate extending between the connecting portion and the wire barrel;

first and second spaced apart side walls projecting up from opposite first and second lateral sides of the base plate;

at least one restriction between the connecting portion and the wire barrel and extending unitarily from a location on the first side wall spaced from the base plate and projecting toward the second side wall, at least a portion of the restriction being spaced from the base plate; and a front stop between the connecting portion and the wire barrel and configured for contacting and positioning a longitudinal front end of the end of the wire; whereby the end portion of the wire is positioned between the restriction and the base plate for restricting movement of the end portion of the wire away from the base plate.

9. The terminal fitting of claim 8, wherein the restriction is a first restriction and the terminal fitting further comprising a second restriction extending unitarily from a location on the second side wall spaced from the base plate and projecting toward the first side wall.

10. The terminal fitting of claim 8, wherein the front stop is unitary with the restriction.

11. The terminal fitting of claim 8, wherein the front stop is between the connecting portion and the restriction.

12. The terminal fitting of claim 8, wherein the restriction bulges unitarily out from the base plate.

13. The terminal fitting of claim 12, further comprising a front stops joined unitarily to a side of the restriction facing the connecting portion and configured for contacting a longitudinal front end of the end of the wire, the front stop and the restriction defining a dome-shaped bulge on the base plate.

* * * * *